US007147030B2

(12) United States Patent
Dalle Nogare et al.

(10) Patent No.: US 7,147,030 B2
(45) Date of Patent: Dec. 12, 2006

(54) OPERATION GROUP FOR CURTAINS WITH WINDING UP ROLL

(75) Inventors: Pietro Dalle Nogare, Mansue' (IT); Simone Dalle Nogare, Manue' (IT)

(73) Assignee: Dalex S.r.l., Treviso (IT)

( * ) Notice: Subject to any disclaimer, the term of this patent is extended or adjusted under 35 U.S.C. 154(b) by 179 days.

(21) Appl. No.: 10/504,220

(22) PCT Filed: Feb. 17, 2003

(86) PCT No.: PCT/IB03/00528

§ 371 (c)(1),
(2), (4) Date: Aug. 11, 2004

(87) PCT Pub. No.: WO03/071080

PCT Pub. Date: Aug. 28, 2003

(65) Prior Publication Data

US 2005/0205224 A1 Sep. 22, 2005

(30) Foreign Application Priority Data

Feb. 19, 2002 (IT) ..... BO2002A0082

(51) Int. Cl.
*E06B 9/56* (2006.01)

(52) U.S. Cl. ..... 160/315; 160/297

(58) Field of Classification Search ..... 160/323.1, 160/315, 297, 301, 306, 313, 319, 321
See application file for complete search history.

(56) References Cited

U.S. PATENT DOCUMENTS 1,008,748 A * 11/1911 Snavely ..... 160/297
1,459,155 A * 6/1923 Ioor ..... 160/25
1,502,197 A * 7/1924 Hill ..... 160/293.1
1,726,589 A * 9/1929 Schultes ..... 160/315
1,853,150 A * 4/1932 Schultes ..... 160/306
2,586,340 A * 2/1952 Hyde ..... 160/297
4,222,601 A * 9/1980 White et al. ..... 296/37.16
4,427,050 A * 1/1984 Toppen ..... 160/315
4,466,475 A * 8/1984 Saito et al. ..... 160/297
5,099,906 A * 3/1992 Chigusa et al. ..... 160/297
5,881,792 A * 3/1999 Cheng ..... 160/263
6,131,642 A 10/2000 Welfonder
6,529,323 B1 * 3/2003 Okumura ..... 359/461

(Continued)

FOREIGN PATENT DOCUMENTS

DE 500 236 C 6/1930

(Continued)

*Primary Examiner*—David Purol
(74) *Attorney, Agent, or Firm*—William J. Sapone; Coleman Sudol Sapone PC

(57) ABSTRACT

An operation group for use with a curtain winding roll is described relative to a first embodiment and a second embodiment (G1, G2), the first for automatically and the second for manually winding up curtains. According to the first embodiment (G1), the operation group includes a mechanism (1), connected to a head (3*a*) of a curtain winding roll (3). A stop device (90) defines a hub (9) connected to the remaining winding roll head. According to the second embodiment (G2), the operation group has instead a pulley (95) defining the hub (9). The mechanism (1) is operated by first sliding the barrel (5), connected to a first elastic element (2) situated inside the roll (3), axially to disengage a clutch (7), and then by rotating the barrel in one direction or another. When the mechanism is released, a second elastic element (6) slides the barrel (5) back, to re-engage the clutch (7). Adapter rings (30,300) allow use of the operation group with rolls (3) of different diameters.

11 Claims, 3 Drawing Sheets

U.S. PATENT DOCUMENTS 6,530,717 B1 * 3/2003 Bergamaschi ..... 403/325

FOREIGN PATENT DOCUMENTS

EP 0 356 403 2/1990

EP 0 821 130 A 1/1998

* cited by examiner

OPERATION GROUP FOR CURTAINS WITH WINDING UP ROLL

BACKGROUND OF THE INVENTION

The invention relates to curtains with winding up roll, to be applied to windows and the like.

DESCRIPTION OF THE PRIOR ART

As it is known, the above mentioned curtains are unwound from a winding roll, with a downward movement, up to a position, in which a desired darkening, partial or total, is reached.

The known devices for stabilizing the curtain in different positions, in which it is arranged, as well as for facilitating its winding, up, are connected to the winding roll.

Basically, there are two kinds of curtains, one is automatically wound up and the other is manually wound up.

The first type includes elastic means, which are gradually loaded due to the roll rotation, during the curtain unwinding, and which can supply a reaction force strong enough to wind up the roll automatically, after having suitably released a stop device, situated in the roll.

The stop device is aimed at acting automatically in order to stabilize the curtain when the unwinding action is stopped, after the desired position has been reached.

The second type of curtains includes elastic means analogous to the first type, but calibrated in such a way that the reaction force supplied thereby is a function of the curtain weight, in proportion to the unwound quantity thereof.

In the latter case, the curtain position is substantially auto-stabilized and the above mentioned stop device is not necessary.

Instead, a pulley is mounted coaxial and integral with the winding roll, and is operated by a chain to wind up and unwind the curtain.

The above mentioned elastic means, present in the first and second type of curtain stabilizing devices, usually include at least one helical spring, whose ends are fastened respectively, to the winding roll and to a motionless element; consequently, the roll rotation, during the curtain unwinding, determines the spring torsion with the increase of the load, and consequently, of the elastic reaction.

Obviously, the curtain good working depends on the correct reaction of the elastic means, which is calibrated by an initial pre-loading of the elastic means, obtained usually by known pre-loading means, situated near the winding roll end.

In known mechanisms, the adjustment of the pre-loading value is often difficult, because the operation requires the use of tools and, not seldom, it causes a risk of the spring unintentional unloading, which obviously results in the necessity to repeat the operation.

The stop device of the automatically winding up curtains is connected to the related pre-loading mechanism, in the same operation group, which causes obvious constructive complications.

The group is not appropriate to be applied to manually winding up curtains, which do not include the stop device, as specified above.

The construction of curtains of the latter type needs a particular pre-loading mechanism, otherwise, it is necessary to make the group stop device inoperative.

Obviously, the dimensions of the above mentioned curtains, either of one or of another type, can be very different, according to their application.

Consequently, the diameters of the used winding rolls are different, in function of the curtain dimensions, and it is necessary to provide appropriate pre-loading devices.

Actually, it is necessary to produce specific elements in accordance with different production needs, elements, which are not interchangeable, although substantially and functionally similar.

This causes a series of well known drawbacks, concerning costs and handling level, which is in contrast with modern production criteria tending to unify the elements as much as possible.

SUMMARY OF THE INVENTION

The object of the present invention is therefore to avoid the above mentioned functional and productive drawbacks by proposing an original operation group for curtains with a winding roll.

The group, according to the invention, includes a pre-loading mechanism, whose conformation allows its easy handling in order to adjust the pre-loading of the roll elastic means, without the risk of unintentional unloading of the latter.

For the same purpose, the pre-loading mechanism must have the possibility to be used alone, in the manually winding up curtains, or together with a stop device, in the automatically winding up curtains.

Another object of the present invention is to propose a group, which can be easily adapted to be mounted on the winding rolls of different diameters, without changing the parts forming it.

The above mentioned objects are achieved, in accordance with the contents of the claims, by an operation group for curtains with winding roll, the group including a mechanism and a hub connected to the respective ends of said roll, with said mechanism aimed at imposing and stabilizing a pre-established pre-loading condition for first elastic means, present in said winding roll.

The operation group is characterized in that:

said mechanism includes a sleeve and a barrel, the barrel being introduced into the sleeve with possibility to move axially, against the action of associated elastic means, between a first and a second positions;

clutch means are situated between the sleeve and the barrel and are mutually engaged when said barrel is in the first position, to link the sleeve to the barrel with respect to rotation, and are disengaged from each other, when said barrel is in the second position to allow the sleeve and barrel a relative free rotation;

said mechanism is associated to said first end of the winding roll, in such a way that: said sleeve is coaxially fixed to the first end;

said barrel has an axial hole and is slidingly keyed onto a shaft situated inside said winding roll and motionless with respect thereto;

a proximal end of said first elastic means of the winding roll is linked to said barrel and shaft, with respect to rotation;

said barrel has, at its outer end, a prismatic shank, which is operated to make said barrel slide axially, with consequent disengagement of said clutch means and then, to make said barrel rotate in either one or another direction with respect to said sleeve, to increase or decrease the pre-loading of said first elastic means;

the winding roll-mechanism assembly can be mounted on support means, so that said shank is coupled with a complementary seat, made in the support means, and the clutch means are disengaged.

BRIEF DESCRIPTION OF THE DRAWINGS

The characteristic features of the invention, which are not evident from what has been said above, will be better explained in the following description of a preferred embodiment of the proposed group, in accordance to the contents of claims and with the help of the enclosed drawing tables, in which:

BEST MODES OF CARRYING OUT THE INVENTION

Figure 1:
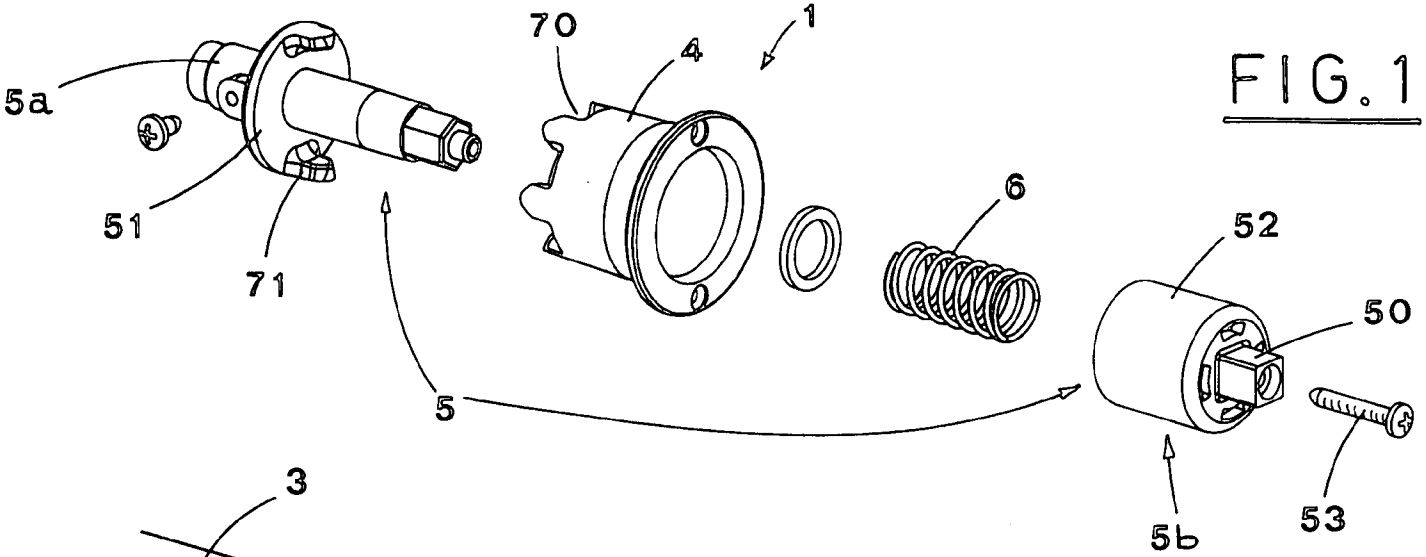
FIG. 1 is a perspective exploded view of a pre-loading mechanism for the group described herein.

With reference to the above Figures, the reference numeral 1 indicates a pre-loading mechanism, being a part of the proposed operation group which is aimed, according to a first embodiment G1, at being connected to the winding roll 3 of automatically winding up curtains, and, according to a second embodiment G2, to the winding roll 3 of manually winding up curtains.

The mechanism 1 is aimed at imposing and stabilizing a predetermined pre-loading value for first elastic means 2, formed by a spiral spring situated inside the winding roll 3 and aimed, in known way, at supporting the weight of the curtain unwound from the roll 3, as well as at facilitating the curtain winding up on the roll 3.

As it has already been mentioned in the introductory statement, the pre-loading value is different for two types of curtains, even of the same dimension and weight, because in one case the curtain is wound up by the elastic means, while in the other case it is wound up manually.

The mechanism 1 includes a sleeve 4, a barrel 5, introduced into the sleeve 4, and second elastic means 6, situated between the sleeve and the barrel.

Front side acting clutch means 7, situated between the sleeve and the barrel, are defined by a plurality of spaces 70, regularly spaced apart, made in the sleeve 4, and by complementary claws 71 made in a disc 51 formed by the barrel 5.

The barrel 5 can move axially between two positions P1, P2.

When the barrel 5 is in the position P1, the clutch means 7 are connected and when the barrel is in the position P2, the clutch means are disconnected.

Therefore, in the position P1, the barrel 5 is driven into rotation along with the sleeve 4, while in the position P2 it can freely rotate with respect to the sleeve.

The second elastic means 6 are situated inside the sleeve 4 and act, in axial direction, on a cup 52, likewise formed by the barrel 5, so that the claws 71 and the spaces 70 are mutually engaged in absence of other forces.

Due to the assembling necessities, the barrel 5 is formed by two pieces 5*a*, 5*b* (FIG. 1), which are connected, e.g. by wrench coupling and screw means 53.

Figure 2:
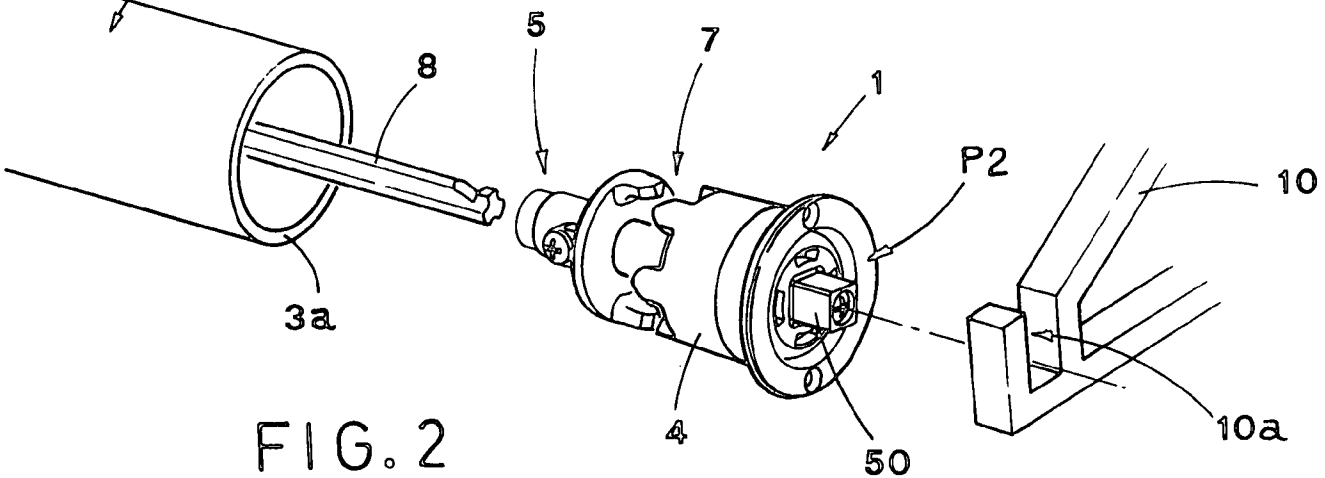
FIG. 2 shows the same mechanism of FIG. 1 in assembled condition.

A prismatic shank 50, formed by the piece 5*b*, extends externally with respect to the sleeve 4, when the mechanism 1 is assembled (FIG. 2), while an axial hole, not shown, facing the opposite side with respect to the shank 50, is made in the piece 5*a*.

The mechanism 1 is to be connected to a end 3*a* of the winding roll 3, in such a way that:

the sleeve 4 is coaxially fastened to the end 3*a;* the barrel 5 is slidingly keyed, by the axial hole, on a grooved shaft 8, made in known way inside the winding roll 3 and motionless with respect to the latter;

the barrel 5 is driven into rotation along with the proximal end 2*a* of the spring 2 of the winding roll 3, to which the remaining end is fastened, by a connecting pin 13, attached for rotation to the roll 3. In particular, the proximal end 2*a* of the spring 2 slides, coupled with the shaft 8, in a way completely known and not shown in detail.

For this purpose, the proximal end 2*a* is fastened to a bushing 2*b*, which is slidingly coupled with the shaft 8 by suitable grooves and corresponding complementary protrusions made in the shaft 8 and the bushing 2*b*.

When the assemblage is finished, it is possible to adjust the value of the first elastic means 2 pre-loading, acting manually or with suitable instruments, on the prismatic shank 50, first to make the barrel 5 slide axially from the position P1 to the position P2, thus disengaging the clutch means 7 and then, to increase or reduce the pre-loading by rotating the barrel 5 with respect to the sleeve 4, in one direction or the other.

The release of the barrel 5 makes it slide axially in the opposite direction, from the position P2 to the position P1, due to the elastic reaction of the second elastic means 6, and consequently the clutch means 7 become engaged.

In case the claws 71 and the spaces 70 are not aligned during the release of the barrel, the barrel 5 is driven, by the first elastic means 2, so as to rotate a bit, just until the claws 71 enter the respective spaces 70.

The angular amplitude of the above-mentioned rotation is very limited, inversely proportional to the number of claws 71 and spaces 70, but anyway it does not affect in noticeably way the imposed pre-loading.

The winding roll-mechanism assembly is aimed at being mounted on support means 10, situated beside thee end 3*a* (FIG. 2), so that the shank 50 is coupled with a complementary seat 10*a*, made in the support means 10 and that the barrel 5 is brought to the position P2, in which the clutch means 7 are disengaged.

In this way, the roll 3 is free to rotate in one direction, to unwind the curtain, and in the other direction, to wind up the curtain, with the defined pre-loading of the first elastic means 2.

Besides the described mechanism 1, the proposed operation group includes also a hub 9, which is aimed at being connected to the remaining end of the winding roll 3, to allow the latter to be fastened to corresponding support means, not shown, like the ones present in the opposite end 3*a*.

Figure 3:
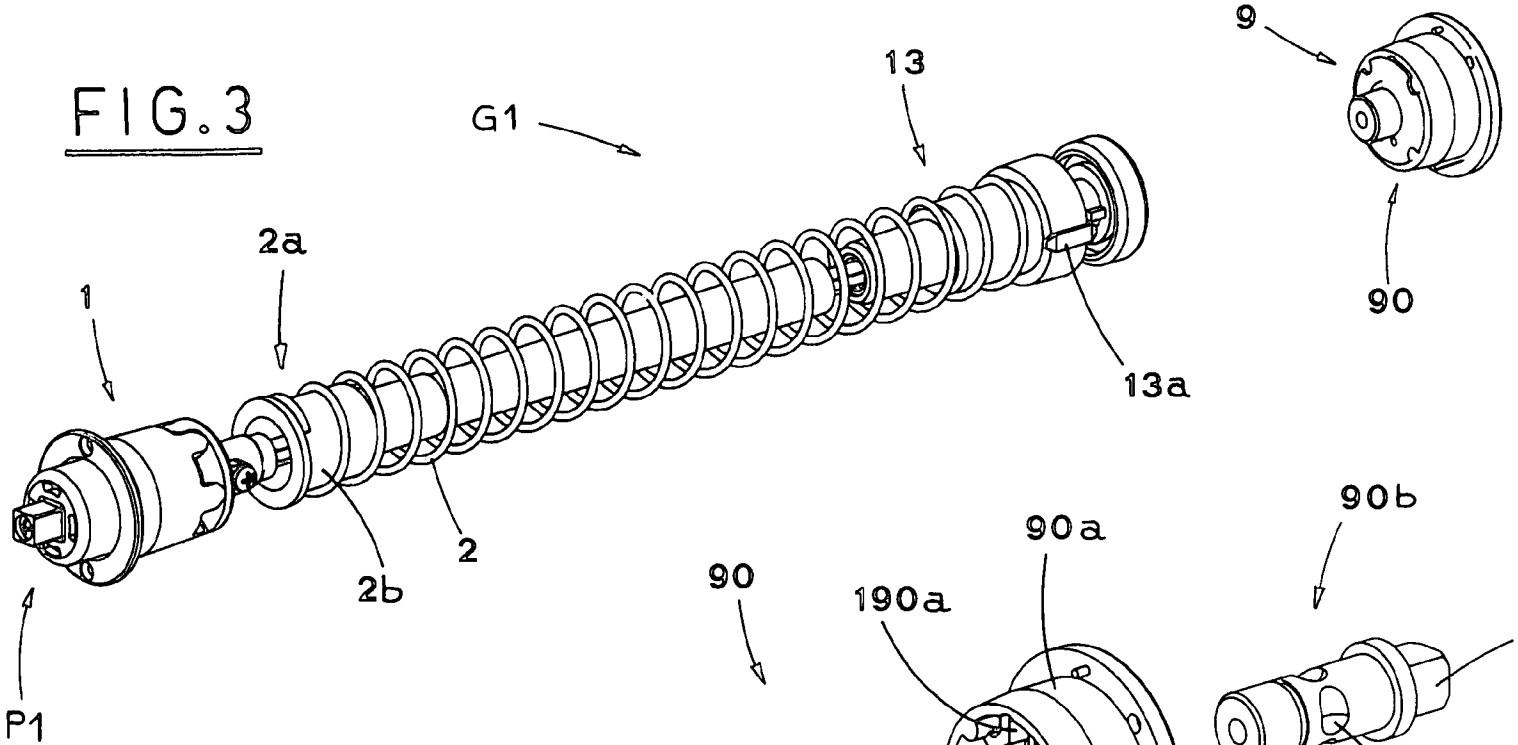
FIG. 3 is a perspective view of a first configuration of the operation group for automatically winding up curtains.
Figure 4:
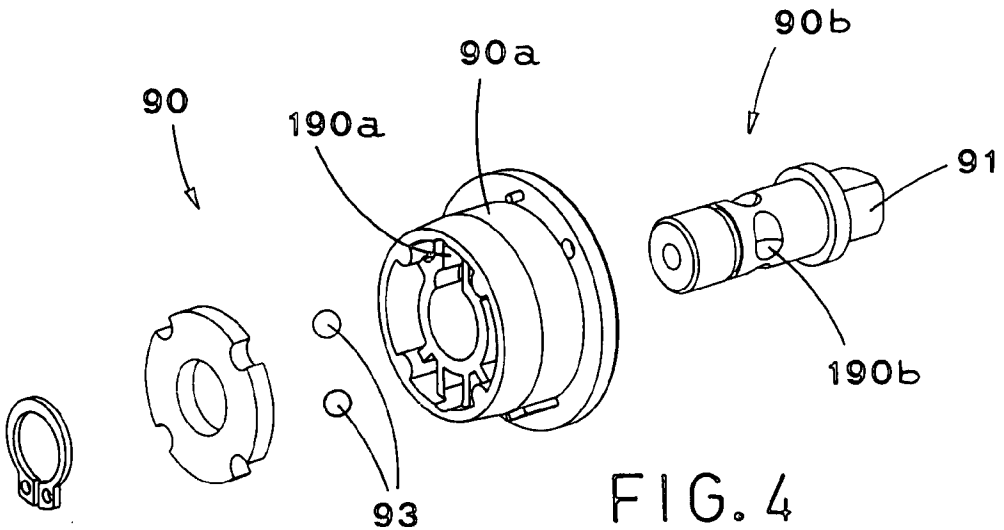
FIG. 4 is a perspective exploded view of a stop device in the group according to the first configuration.

According to the above mentioned first embodiment G1 of the operation group for automatically winding up curtains (FIG. 3 and FIG. 4), the mechanism 1 is connected to a stop device 90, which forms the hub 9 and acts automatically to stabilize the curtain in the desired position, as already mentioned in the introductory statement.

According to shown non-limiting example, the stop device 90 includes two cylindrical elements 90*a*, 90*b*, the first of which is integral with the corresponding roll 3 end, similarly to the sleeve 4, while the second is introduced into the first one, similarly to the barrel 5, and is prevented from rotating by a relative prismatic shank 91 coupled with a seat of the corresponding support means.

Two balls 93, situated between the two elements 90*a*, 90*b*, are introduced freely into first radial seats 190*a* formed by the first element 90*a*.

Second radial seats 190*b*, of suitable shape, are made in said second element 90*b*: the unwinding of the curtain is free, independently from the roll 3 rotation speed.

When the curtain reaches the desired position, the unwinding operation is stopped; by allowing a short going back of the curtain, which is pulled by the first elastic means 2 and tends to wind up, the balls 93 are allowed to engage, due to gravity, with the second seats 190*b*, so that the roll 3 becomes locked.

In order to unlock the stop device 90, it is necessary to operate the curtain by unwinding it by another short piece, then to release it suddenly: the sudden roll rotation in the winding up direction, determined by the first elastic means 2, keeps the balls 93 in the first seats 190*a*, due to the centrifugal force, so that the curtain can be completely wound up on the roll 3.

Figure 5:
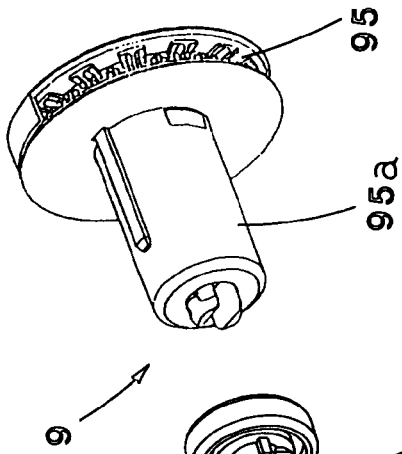
FIG. 5 is a perspective view of a second configuration of the operation group for manually winding up curtains.
Figure 5:
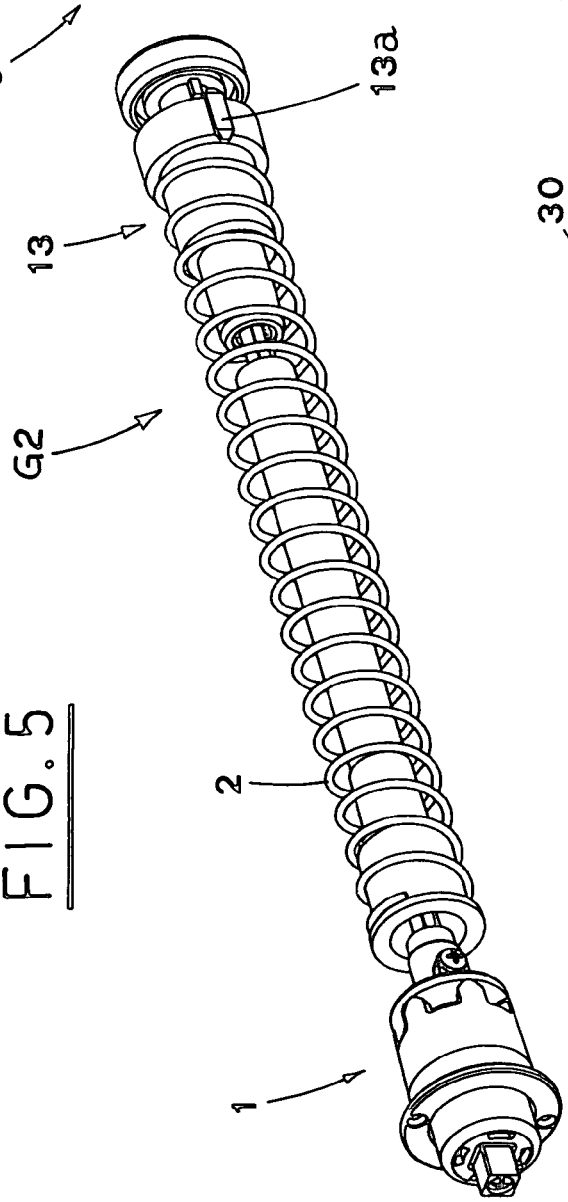

According to the second embodiment G2 of the operation group for manually winding up curtains (FIG. 5), the mechanism 1 is connected to a pulley 95, defining the hub 9 and integral with the winding roll 3.

The pulley 95 is operated, by a not shown chain, to wind up the curtain, the same chain is used to unwind the curtain.

Finally, the operation group includes two optional elements to be used in case the dimensions of the winding roll 3 are bigger than the one concerned so far, as belonging to another dimension category.

Figure 6:
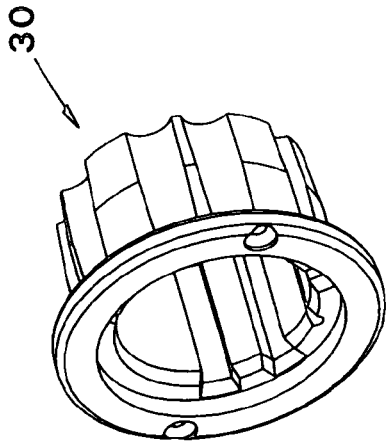
FIG. 6 shows a first adaptor ring to be used with the proposed group.

FIG. 6 shows a first adapter ring 30, which is aimed at being fitted on the sleeve 4; on the opposite side, another identical first adapter ring 30 is fitted onto the first cylindrical element 90*a*, with the group set as in the first embodiment G1, or is fitted on the pulley 95, with the group set as in the second embodiment G2.

The adaptor ring 30 is made in such a way as to maintain the constraints existing between the roll 3, the sleeve 4 and the element 90*a*, as well as the constraints existing between the same roll 3 and the pulley 95, with respect to rotation.

Figure 7:
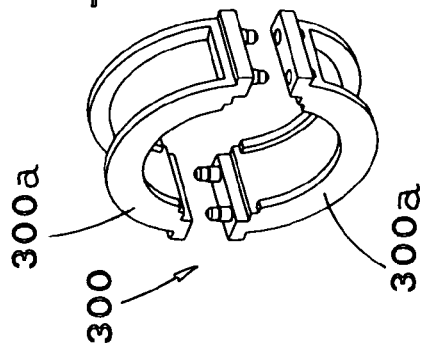
FIG. 7 shows a second adaptor ring to be used with the proposed group.

FIG. 7 shows a second adaptor ring 300, including two half-rings 300*a* to be mounted in a corresponding position of the connecting pin 13. The section is aimed at fastening the connecting pin to the roll 3.

The adaptor ring 300 is made in such a way as to maintain the constraint existing between the roll 3 and the connecting pin 13, with respect to rotation.

The use of the adaptor rings 30, 300 allows to use the same operation group for rolls of different diameters, which is evidently positive for the costs reduction.

The proposed operation group is extremely versatile, due to the fact that the pre-loading mechanism 1 can be employed with or without the stop device 90, because it is physically separated therefrom.

In particular, the mechanism 1 becomes universal, because it can be mounted on any type of roll, no matter of whether the curtain unwinding is automatic or manual.

Another advantage, deriving from the constructive characteristics of the mechanism 1, concerns the easiness, with which the pre-loading of the first elastic means 2 can be adjusted, without risking that a clumsy movement can unload them completely.

The security of the mechanism 1 is well seen when, for any reason, the roll must be disassembled from the supports: actually, as soon as the prismatic shank 50 is removed from the relative seat 10*a*, the barrel 5 is brought, by the action of the second elastic means 6, back to the position P1, in which the clutch means 7 are mutually engaged, so that the pre-loading of the first elastic means 2 is kept at the prefixed value.

It should be understood that the foregoing description of the invention is intended merely to be illustrative thereof, and that other embodiments, modifications, and equivalents may be apparent to those skilled in the art without departing from the scope of the claims appended thereto.

The invention claimed is:

1. An operation group incorporated with a winding roll for automatically rolling up at least one curtain, the operation group comprising:

a shaft insertable into and fixable within the winding roll;

a hub (9) connected to an end of said winding roll;

first elastic means (2) situated within the winding roll for automatically winding up the curtain on the roll, the first elastic means having a first end linked to said shaft (8) and a second end fixed to said winding roll; and, a mechanism (1) for imposing and stabilizing a pre-loading condition for said first elastic means (2), the mechanism located within said winding roll (3), said mechanism having:

a sleeve (4) introduced into said winding roll and coaxially fixable to a first end (3*a*) of said winding roll;

a barrel (5) having an axial hole, keyed slidingly on said shaft and axially movable within the sleeve between a first position and a second position (P1, P2);

a prismatic shank (50), provided at an end of said barrel for coupling with a complementary seat (10*a*), located in support means (10) for said winding roll; and, clutch means (7) situated between the sleeve (4) and the barrel (5), the clutch means mutually engaging said barrel and said sleeve when said barrel (5) is in the first position (P1) and disengaging said barrel (5) from said sleeve when in the second position (P2);

second elastic means (6), disposed between said barrel and said sleeve for biasing said barrel so as to keep the barrel in said first position (P1);

said clutch means including a plurality of recesses (70) regularly spaced apart and provided in said sleeve, said barrel 5 having a disk (51) having complementary claws (71) facing said recesses and engagable therewith.

2. The operation group according to claim 1, wherein said second elastic means (6) are situated inside said sleeve (4), said elastic means acting axially on a cup (52) formed by said barrel (5).

3. The operation group according to claim 1, wherein said barrel (5) is formed by two pieces (5*a*, 5*b*), locked to each other when the barrel (5) is mounted in said sleeve (4).

4. The operation group according to claim 1, wherein said second elastic means (6) are situated inside said sleeve (4), said second elastic means acting axially on a cup (52), formed by said barrel (5), said barrel (5) formed by two pieces (5*a*, 5*b*), locked to each other when the barrel (5) is mounted in said sleeve (4).

5. The operation group according to claim 1, wherein said hub (9) is has a stop device (90), connected to said mechanism (1).

6. The operation group according to claim 5, wherein:

said stop device (90) is formed by a first cylindrical element (90*a*) and a second cylindrical element (90*b*);

said first cylindrical element being fastened to a first end of said roll (3), the second cylindrical element being introduced into said first cylindrical element and being connected to means for making it stationary;

said first cylindrical element and second cylindrical element (90*a*, 90*b*) each having first radial seats (190*a*) and second radial seats (190*b*); balls (93) housed in said first radial seats, during curtain unwinding and winding, to determine an unlocked condition for the stop device (90), said balls (93) engaging with said second radial seats (190*b*) when rotation is stopped and a short backward rotation is allowed, to provide a locked condition for the stop device (90), wherein the curtain is stabilized in a pre-established position.

7. The operation group according to claim 1 further comprising a first adapter ring and a second adaptor ring (30, 300), respectively, which allow the operation group to be mounted on winding rolls (3) of different dimensions.

8. The operation group according to claim 7, wherein said first adaptor ring (30) is keyed onto said sleeve (4) and on said first cylindrical element (90*a*), said first adaptor ring (30) being shaped so that the pre-existing constraints to the rotation between said roll (3), said sleeve and said first cylindrical element (90*a*) are maintained.

9. The operation group according to claim 7, wherein said first adaptor ring (30) is keyed onto a shaft (95*a*) of a pulley (95), said first adaptor ring (30) being shaped so that the pre-existing constraints to the rotation between said roll (3), said sleeve (4), said first cylindrical element (90*a*), and said pulley (95) are maintained.

10. The operation group according to claim 7, wherein said second adaptor ring (300) is formed by two half-rings (300*a*) and is mounted in a section (13*a*) of a connecting pin (13), in which the connecting pin is fixed with respect to said roll (3), and in that said second adaptor ring (300) is shaped to maintain said rotation constraint.

11. The operation group according to claim 1, wherein a proximal end (2*a*) of said first elastic means (2) is fastened to a bushing (2*b*) slidingly coupled with the shaft (8).

* * * * *